United States Patent [19]

Ting

[11] Patent Number: 4,676,579

[45] Date of Patent: Jun. 30, 1987

[54] COMPLIANT TERMINAL

[75] Inventor: Tse-wu Ting, Yokohama, Japan

[73] Assignee: E. I. Du Pont de Nemours and Company, Wilmington, Del.

[21] Appl. No.: 821,328

[22] Filed: Jan. 22, 1986

[30] Foreign Application Priority Data

Apr. 30, 1985 [JP] Japan ..... 60-64991[U]

[51] Int. Cl.[4] ..... H01R 13/428

[52] U.S. Cl. ..... 439/825; 439/82; 439/834; 439/873

[58] Field of Search ..... 339/17 C, 220 R, 220 A, 339/220 L, 221 R, 221 M, 221 L, 252 R, 252 P, 217 R

[56] References Cited

U.S. PATENT DOCUMENTS

| | | | |
|---|---|---|---|
| 2,329,471 | 9/1943 | King | 339/221 R |
| 3,538,486 | 11/1970 | Shlesinger, Jr. | 339/217 R |
| 3,717,841 | 2/1973 | Mancini | 339/17 C |
| 4,070,077 | 1/1978 | Clark | 339/17 C |
| 4,111,518 | 9/1978 | Zurcher | 339/252 R |
| 4,384,757 | 5/1983 | Andrews, Jr. et al. | 339/221 R |
| 4,526,429 | 7/1985 | Kirkman | 339/17 C |

*Primary Examiner*—Gil Weidenfeld
*Assistant Examiner*—Gary F. Paumen

[57] ABSTRACT

A compliant terminal comprises a pair of legs facing each other. Each of the legs is provided with an outwardly expanded portion in the intermediate portion. The expanded portions form an elastic contact portion for compressed fitting with a through hole. The leg portion is also provided with a pair of inward projections in the boundary region between the intermediate and free end portions. The inward projections of the two legs are substantially in contact. Therefore when the legs are inserted to the hole, the ends of legs outwardly swing about the contact point of the inward projections, and the compliant terminal is prevented from being withdrawn from the hole.

1 Claim, 4 Drawing Figures

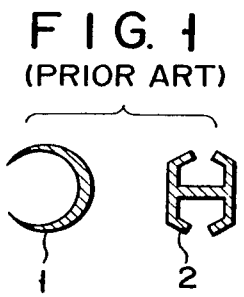
FIG. 1
(PRIOR ART)
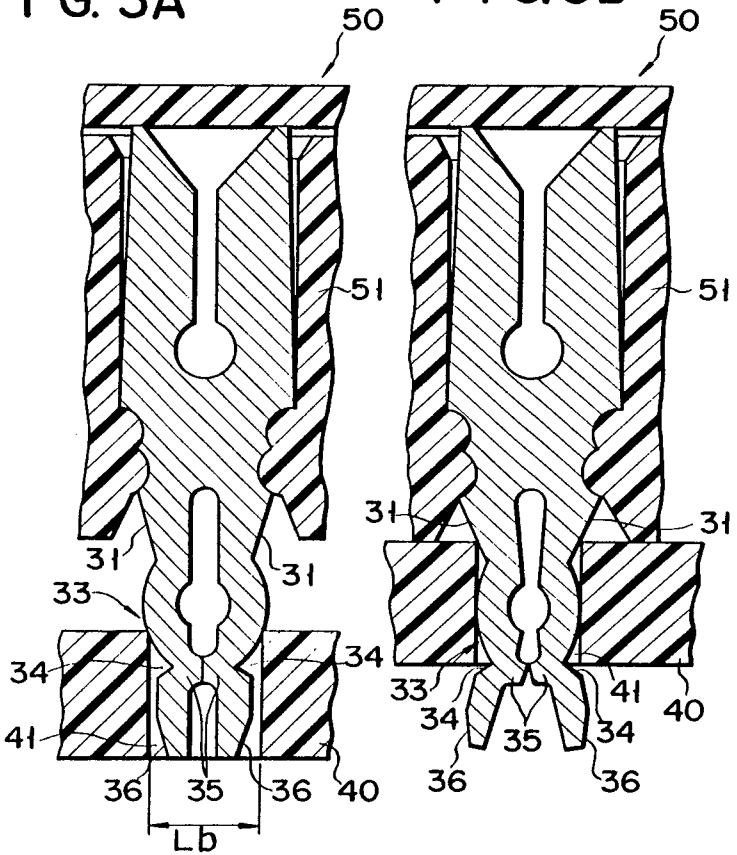
FIG. 3A
FIG. 3B
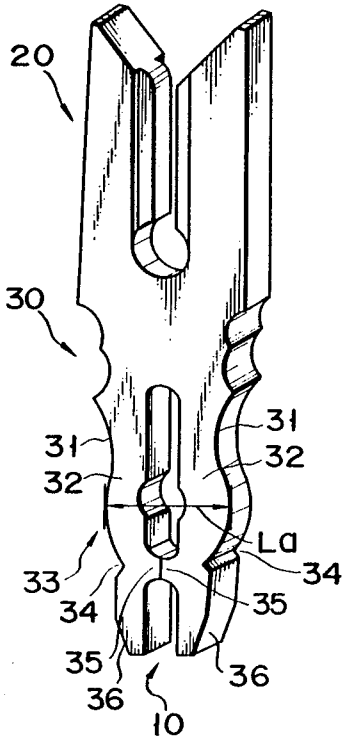
FIG. 2

COMPLIANT TERMINAL

BACKGROUND OF THE INVENTION

This invention relates to a compliant terminal which is compressed and fits into a through hole of a printed circuit board and can obviate the necessity of a soldering with respect to the hole.

A conventional compliant terminal of this type is such that its contact section is C- or H- shaped in cross-section, as shown in FIG. 1 by reference character 1 or 2 respectively. They are brought into intimate contact with a hole of a printed circuit board. However, the conventional compliant terminal was complex in its contact section configuration, difficult to miniaturize and high in cost. Furthermore, it tends to slip away from the hole, although it provides a good contact with the through hole.

In view of the foregoing, it is an object of this invention to provide a compliant terminal which is simpler in construction, assures a positive contact with a hole of a printed circuit board and also assures a positive latching engagement with the hole against a slippage away from it.

SUMMARY OF THE INVENTION

This and other object of the invention are accomplished in accordance with the principle of the invention by providing a compliant terminal which includes a pair of facing legs. The intermediate region of the pair has outwardly expanding portions which provide a compressible contact area where the legs are brought into contact with an associate through hole of a printed circuit board. Inwardly extending projections are provided at a boundary between the intermediate region and the free end region of each leg. And these inward projections face each other.

In the compliant terminal so constructed, the legs are inserted into an associate hole of a printed circuit board with their free ends down. At this time, the compressible contact area is elastically deformed in a radial direction of the hole and it is positively retained on the inner wall of the hole, and portions of opposite end faces of both the inward projections abut with each other, as a result, the free ends of the legs swing outwardly with the abutting point as a fulcrum. Thereby the legs and thus the terminal are prevented from slipping away from the hole.

Further features of the invention, its nature and various advantages will be more apparent from the accompanying drawings and the following detailed description of the invention.

BRIEF DESCRIPTION OF THE DRAWINGS

FIG. 1 is a cross-sectional view showing a contact area of a conventional compliant terminal;

FIG. 2 is a perspective view showing a compliant terminal according to one embodiment of this invention; and FIG. 3A and FIG. 3B are cross-sectional views showing the attachment of the compliant terminal to a printed circuit board.

DETAILED DESCRIPTION OF THE PREFERRED EMBODIMENT

This invention will be explained below in connection with FIGS. 2 and 3A and 3B.

In FIG. 2, compliant terminal 10 has "insulation displacement connection" section 20 at an upper portion and another connection section 30 at a lower portion. These sections 20 and 30 are formed integrally of conductive plate. Connection section 30 includes a pair of oppositely facing legs 31. At the intermediate region of the pair, portions 32 are curved outwardly. A pair of arcuate cutouts are formed on the inner surface of the intermediate region of legs 31. Each of cutouts is located on the back side of the associate expanding portion 32. A length La between the tops of arcuate portions 32 is greater than a diameter Lb of hole 41 of printed circuit board 40 shown in FIG. 3A. The arcuate portions 32 with the cutout serve as an elastic contact area 33 where they come into elastic contact with hole 41.

Notches 34 are formed at a boundary between the intermediate region and a free end region of the leg. A pair of inwardly extending projections 35 are formed on the inner walls of legs 31 which correspond in level to notches 34 of legs 31. The projections 35 substantially face each other.

Inwardly inclined tapering surfaces 36 are provided on the outer surfaces of the free end portions of the legs 31. That is, compliant terminal 10 is convergent at the lowest portions of legs 31. When legs 31 are inserted into hole 41, the end regions of legs 31 including notches 34 extend beyond the rear surface of the board.

Compliant terminal 10 so constructed is attached to housing 51 of electric connector 50 shown in FIGS. 3A and 3B. Electric connector 50 is attached to printed circuit board 40 by forcing legs 31 into through hole 41 with the free ends of legs 31 down. Since, in this case, the end portions of legs 31 are formed as tapering surfaces 36 it is easier to insert legs 31 along the hole 41.

Legs 31 are inserted into the associate hole, untill the end regions of them project out of the rear surface of board 40, with the intermediate sections, i.e., the elastic contact area 33, deflecting inwardly and fitting to the hole as shown in FIG. 3B. Thus, elastic contact area 33 is positively retained on the inner wall of hole 41. As appreciated from FIG. 3B, when elastic contact area 33 begins to be compressed the free ends of legs 31 begin to swing outwardly with abutting point of projections 35 as a fulcrum. Then the notches 34 are brought into latching engagement with the lower edge of the hole at the reverse surface of board, whereby even if such an outer force is applied to housing 51 that lifts up the housing 51, legs 31 will not slip away from hole 41.

Although the invention has been explained as regards the compliant terminal having "insulation displacement connection" section 20, it can be extensively applied to a variety of compliant terminals. For example, connecting section 20 can be replaced by a general female contact or others.

The compliant terminal according to this invention assures a positive contact with the through hole of the printed circuit board and, in consequence, prevents a slippage away off a corresponding hole.

The compliant terminal according to this invention can be obtained by merely flanking a flat-like conductive plate. It is, therefore, possible to obtain a compliant terminal which is inexpensive and compact in dimension.

What is claimed is:

1. A electrical terminal for compliant mounting in a plated, through hole of a printed circuit board, said terminal having at one end a compliant mounting portion comprising:

a pair of oppositely facing legs extending integrally from one end of the terminal, each leg terminating at a free end with an inwardly tappered surface;

an expanded region formed at a corresponding intermediate portion of each leg, each expanded region having an arcuated outer surface and an arcuate inner surface, the maximum width across said arcuate outer surfaces of said legs being greater than the inner diameter of the printed circuit board hole, a notch formed in an outwardly facing surface of each leg between the expanded region and said free end; and an inwardly extending projection formed along an inwardly facing surface of each leg, each said projection and notch formed at approximately the same corresponding longitudinal position of each leg, the inwardly extending projection of each leg providing a fulcrum point of abutment between said legs, whereby when said terminal is inserted into the hole, the expanded region of each leg will be compressed and the free ends of said legs will swing outwardly from said fulcrum abutment point until said notches are brought into latching engagement with the lower edge of the hole, said compliant mounting portion also thereby making electrical contact within the plated, through hole.

* * * * *